US011591901B2

(12) United States Patent
Fulton et al.

(10) Patent No.: US 11,591,901 B2
(45) Date of Patent: Feb. 28, 2023

(54) SYSTEM FOR DETERMINING RESERVOIR PROPERTIES FROM LONG-TERM TEMPERATURE MONITORING

(71) Applicants: Cornell University, Ithaca, NY (US); The Regents of the University of California, Oakland, CA (US)

(72) Inventors: Patrick Fulton, Brooktondale, NY (US); Emily Brodsky, Santa Cruz, CA (US)

(73) Assignees: Cornell University, Ithaca, NY (US); The Regents of the University of California, Oakland, CA (US)

( * ) Notice: Subject to any disclaimer, the term of this patent is extended or adjusted under 35 U.S.C. 154(b) by 0 days.

(21) Appl. No.: 17/640,874

(22) PCT Filed: Sep. 8, 2020

(86) PCT No.: PCT/US2020/049677
§ 371 (c)(1),
(2) Date: Mar. 7, 2022

(87) PCT Pub. No.: WO2021/046518
PCT Pub. Date: Mar. 11, 2021

(65) Prior Publication Data

US 2022/0268148 A1 Aug. 25, 2022

Related U.S. Application Data

(60) Provisional application No. 62/896,921, filed on Sep. 6, 2019.

(51) Int. Cl.
*E21B 47/07* (2012.01)
*E21B 49/00* (2006.01)

(52) U.S. Cl.
CPC ..... *E21B 47/07* (2020.05); *E21B 49/00* (2013.01)

(58) Field of Classification Search
CPC ..... E21B 49/00; E21B 49/006; E21B 47/07
See application file for complete search history.

(56) References Cited

U.S. PATENT DOCUMENTS 4,120,199 A * 10/1978 Mufti ..... E21B 47/07 374/10
4,832,121 A * 5/1989 Anderson ..... E21B 47/103 166/308.1

(Continued)

OTHER PUBLICATIONS

International Search Report and Written Opinion of PCT/US20/49677, dated Nov. 27, 2020, 12 pages.

(Continued)

*Primary Examiner* — Kenneth L Thompson
(74) *Attorney, Agent, or Firm* — Ryan, Mason & Lewis, LLP

(57) ABSTRACT

An apparatus comprises at least one processing device comprising a processor coupled to a memory. The processing device is configured to obtain time-series temperature data from respective temperature sensors arranged at respective different subsurface depths, and for each of a plurality of pairs of the temperature sensors, to compute a cross-correlation of their corresponding time-series temperature data, to compute a time derivative of the cross-correlation, and to generate an estimate of at least one reservoir property based at least in part on the time derivative of the cross-correlation. At least one automated action is performed based at least in part on the generated estimate, such as, for example, controlling an amount of fluid flow into or out of a particular subsurface region. The generated estimates illustratively comprise estimates of subsurface hydraulic diffusivity.

31 Claims, 4 Drawing Sheets

(56) References Cited

U.S. PATENT DOCUMENTS

| | | | | |
|---|---|---|---|---|
| 5,121,993 | A * | 6/1992 | Carrigan | G01V 9/005 374/43 |
| 5,415,037 | A * | 5/1995 | Griston | E21B 47/07 73/152.14 |
| 8,788,251 | B2 | 7/2014 | Weng et al. | |
| 9,562,988 | B2 | 2/2017 | Wilson et al. | |
| 10,094,719 | B2 * | 10/2018 | Sale | G01K 1/026 |
| 2015/0120194 | A1 | 4/2015 | Chen | |

OTHER PUBLICATIONS

V. F. Bense et al., "Fault Zone Hydrogeology," Earth Science Reviews, vol. 127, Oct. 10, 2013, pp. 171-192.
R. Brauchler et al., "Derivation of Site-Specific Relationships between Hydraulic Parameters and p-wave Velocities based on Hydraulic and Seismic Tomography," Water Resources Research, vol. 48, Mar. 31, 2012, 13 pages.
J. Crank, "The Mathematics of Diffusion," Clarendon Press, Oxford, 1975, 2nd Edition, 421 pages.
Y. Fan et al., "Required Source Distribution for Interferometry of Waves and Diffusive Fields," Geophysical Journal International, vol. 179, Nov. 1, 2009, pp. 1232-1244.
P. M. Fulton et al., "In Situ Observations of Earthquake-Driven Fluid Pulses within the Japan Trench Plate Boundary Fault Zone," The Geological Society of America, Geology, vol. 44, No. 10, Oct. 2016, pp. 851-854.
T. Read et al., "Characterizing Groundwater Flow and Heat Transport in Fractured Rock Using Fiber-Optic Distributed Temperature Sensing," Geophysical Research Letters, vol. 40, May 23, 2013, pp. 2055-2059.
K. G. Sabra et al., "Extracting Time-Domain Green's Function Estimates from Ambient Seismic Noise," Geophysical Research Letters, vol. 32, Feb. 15, 2005, 5 pages.
D. Saffer et al., "Data report: Consolidation, Permeability, and Fabric of Sediments from the Nankai Continental Slope, IODP Sites C0001, C0008, and C0004," in Proceedings of the Integrated Ocean Drilling Program, vol. 314/315/316, Aug. 2011, 61 pages.
D. M. Saffer, "The Permeability of Active Subduction Plate Boundary Faults," Geofluids, vol. 15, Feb. 1, 2015, pp. 193-215.
N. M. Shapiro et al., "High-Resolution Surface-Wave Tomography from Ambient Seismic Noise," Science, vol. 307, Mar. 11, 2005, pp. 1615-1618.
S. A. Shapiro et al., "Characterization of Fluid Transport Properties of Reservoirs Using Induced Microseismicity," Geophysics, vol. 67, No. 1, Jan.-Feb. 2002, pp. 212-220.
R. Snieder, "Extracting the Green's Function from the Correlation of Coda Waves: A Derivation Based on Stationary Phase," Physical Review E, vol. 69, Apr. 29, 2004, 8 pages.
R. Snieder, "Retrieving the Green's function of the Diffusion Equation from the Response to a Random Forcing," Physical Review E, vol. 74, Nov. 2006, 6 pages.
K. Wapenaar et al., "Tutorial on Seismic Interferometry: Part 1: Basic Principles and Applications," Geophysics, vol. 75, No. 5, Sep.-Oct. 2010, 15 pages.
L. Xue et al., "Continuous Permeability Measurements Record Healing Inside the Wenchuan Earthquake Fault Zone," Science vol. 340, Jun. 28, 2013, pp. 1555-1559.
K. Wapenaar et al., "Tutorial on Seismic Interferometry: Part 2: Underlying Theory and New Advances," Geophysics, vol. 75, No. 5, Sep.-Oct. 2010, 17 pages.
V. F. Bense et al., "Distributed Temperature Sensing as a Downhole Tool in Hydrogeology," Water Resources Research, American Geophysical Union, vol. 52, No. 12, Nov. 18, 2016, pp. 9259-9273.
J. D. Bredehoeft et al., "Rates of Vertical Groundwater Movement Estimated from the Earth's Thermal Profile," Water Resources Research, vol. 1, No. 2, Apr.-Jun. 1965, pp. 325-328.
J. Dvorkin et al., "Dynamic Poroelasticity: A Unified Model with the Squirt and the Biot Mechanisms," Geophysics, vol. 58, No. 4, Apr. 1993, pp. 524-533.
P. M. Fulton et al., "Low Coseismic Friction on the Tohoku-Oki Fault Determined from Temperature Measurements," Science, vol. 343, No. 6163, Dec. 6, 2013, pp. 1214-1217.
N. E. Odling et al., "Properties of Fault Damage Zones in Siliclastic Rocks: A Modelling Approach," Geological Society London Special Publications, vol. 249, Jan. 2005, pp. 43-59.
S. Shamsalsadati et al., "Time-series Analysis of Diffusion Interferometry Data and Its Application to Bayesian Inversion of Synthetic Borehole Pressure Data," Geophysics, vol. 79, No. 1, Jan.-Feb. 2014, pp. Q1-Q10.
W. Tanikawa et al., "Fluid Transport Properties in Sediments and Their Role in Large Slip Near the Surface of the Plate Boundary Fault in the Japan Trench," Earth and Planetary Science Letters, vol. 382, Oct. 8, 2013, pp. 150-160.

* cited by examiner

SYSTEM FOR DETERMINING RESERVOIR PROPERTIES FROM LONG-TERM TEMPERATURE MONITORING

CROSS-REFERENCE TO RELATED APPLICATION(S)

The present application claims priority to U.S. Provisional Patent Application Ser. No. 62/896,921, filed Sep. 6, 2019 and entitled "System for Determining Reservoir Properties from Long-Term Temperature Monitoring," which is incorporated by reference herein in its entirety.

FIELD

The field relates generally to information processing, and more particularly to techniques for processing temperature data to determine reservoir properties and other subsurface properties in diverse applications.

BACKGROUND

In applications such as geothermal engineering, petroleum engineering and environmental engineering, there is a need to determine in situ the properties of underground reservoirs that allow fluid to flow. Conventional approaches to determining such properties typically require invasive and difficult to analyze tests or measure proxies that may not be directly related to the flow properties.

SUMMARY

Illustrative embodiments implement functionality for determining reservoir properties from long-term temperature monitoring.

For example, in some embodiments, we use long-term temperature data obtained from sensors in subsurface boreholes to determine the in situ hydraulic diffusivity. As disclosed herein, the ambient temperature fluctuations record flow fluctuations which can be correlated to determine the hydraulic diffusivity between positions of pairs of sensors. Such arrangements advantageously provide accurate and efficient estimates of reservoir properties, so as to overcome the above-noted disadvantages of conventional approaches.

Illustrative embodiments can be used, for example, to passively determine flow properties and other reservoir properties important for a wide variety of applications, including geothermal engineering, petroleum engineering and environmental engineering. Various system components can be controlled in an automated manner using the determined flow properties or other determined reservoir properties.

In one embodiment, an apparatus comprises at least one processing device comprising a processor coupled to a memory. The processing device is configured to obtain time-series temperature data from respective temperature sensors arranged at respective different subsurface depths, and for each of a plurality of pairs of the temperature sensors, to compute a cross-correlation of their corresponding time-series temperature data, to compute a time derivative of the cross-correlation, and to generate an estimate of at least one reservoir property based at least in part on the time derivative of the cross-correlation.

In some embodiments, at least one automated action is performed based at least in part on the generated estimate, such as, for example, controlling an amount of fluid flow into or out of a particular subsurface region. A wide variety of other types of automated actions can be performed in other embodiments. Also, alternative embodiments need not perform any automated action based at least in part on the generated estimate.

The generated estimates illustratively comprise estimates of subsurface hydraulic diffusivity. For example, in some embodiments, generating an estimate of at least one reservoir property based at least in part on the time derivative of the cross-correlation more particularly comprises, for a given one of the pairs of temperature sensors, generating an estimate of subsurface hydraulic diffusivity based at least in part on the time derivative of the cross-correlation and a distance between the given pair of temperature sensors. Generating the estimate of subsurface hydraulic diffusivity illustratively further comprises generating the estimate based at least in part on a comparison of the time derivative of the cross-correlation to one or more temperature response models.

These and other embodiments include but are not limited to systems, methods, apparatus, processing devices, integrated circuits, and processor-readable storage media having software program code embodied therein.

DETAILED DESCRIPTION

Embodiments of the invention can be implemented, for example, in the form of information processing systems comprising one or more processing platforms each having at least one computer, server or other processing device. Illustrative embodiments of such systems will be described in detail herein. It should be understood, however, that embodiments of the invention are more generally applicable to a wide variety of other types of information processing systems and associated computers, servers or other processing devices or other components. Accordingly, the term "information processing system" as used herein is intended to be broadly construed so as to encompass these and other arrangements.

As mentioned above, there is a need to determine in situ the properties of underground reservoirs that allow fluid to flow. Current methods either require invasive and difficult to analyze tests or measure proxies that may not be directly related to the flow properties. Illustrative embodiments disclosed herein make use of ambient noise that naturally exists in subsurface flows to infer the hydrogeological properties, and more particularly utilize ambient noise on a distributed temperature system to infer hydraulic diffusivity. For example, some implementations herein are in the form of passive methods that only probe a borehole via sensors with no manipulation of the reservoir. Such an approach is therefore cheaper and involves less risk than conventional methods. The distributed temperature methods disclosed herein allow us to localize structure and quantify diffusivity around specific faults and features.

The above-described advantages are present in some embodiments, but one or more such advantages may not be present in other embodiments. These particular advantages should therefore not be construed as limiting in any way.

Figure 1:
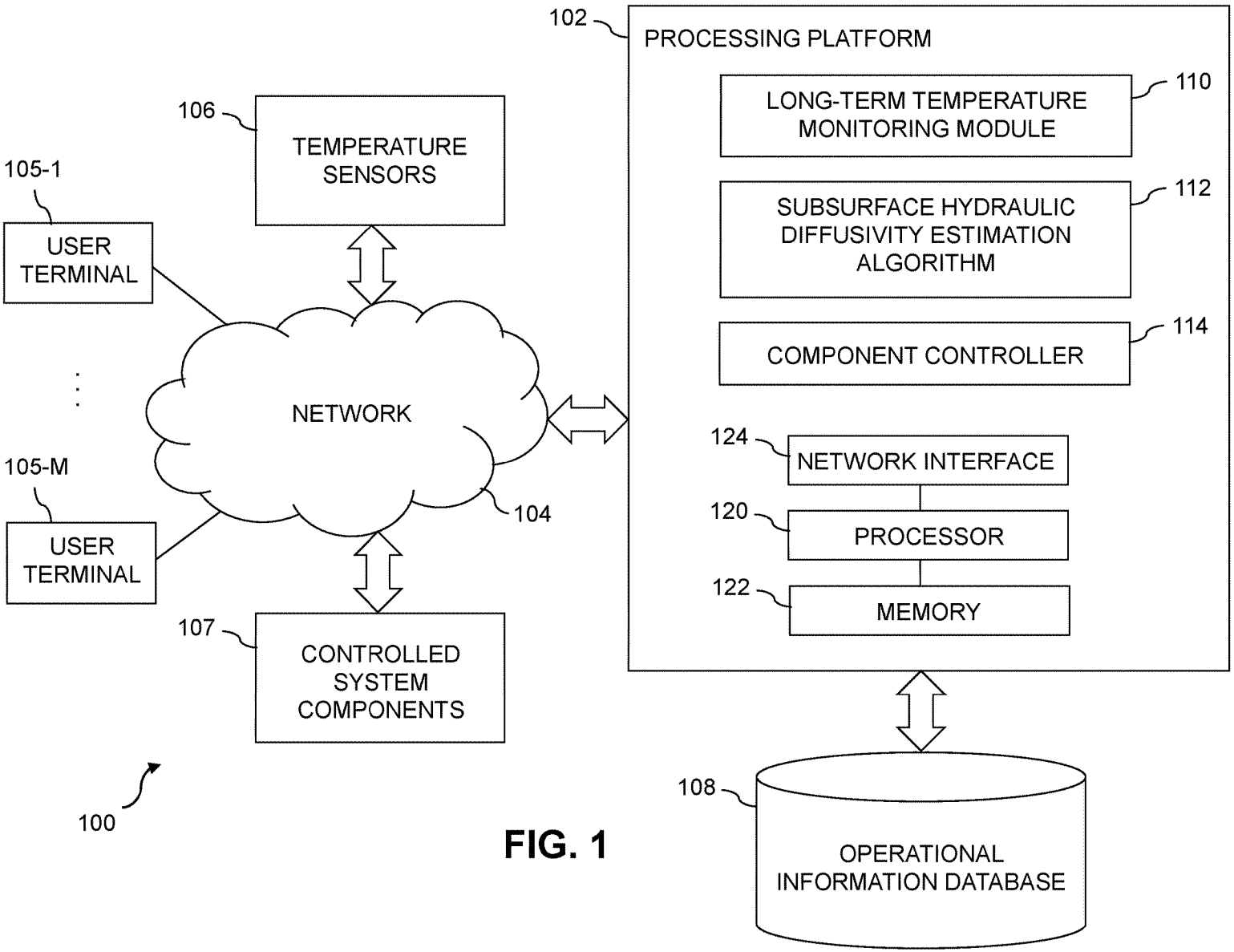
FIG. 1 is a block diagram of an information processing system that incorporates functionality for determining reservoir properties from long-term temperature monitoring in an illustrative embodiment.

FIG. 1 shows an information processing system 100 implementing functionality for determining reservoir properties and providing associated control of system components in an illustrative embodiment. The system 100 comprises a processing platform 102 coupled to a network 104. Also coupled to the network 104 are user terminals 105-1, . . . 105-M, temperature sensors 106 and controlled system components 107. The processing platform 102 is configured to utilize an operational information database 108. Such a database illustratively stores operational information relating to operation of the temperature sensors 106, the controlled system components 107, and the processing platform 102.

Figure 2:
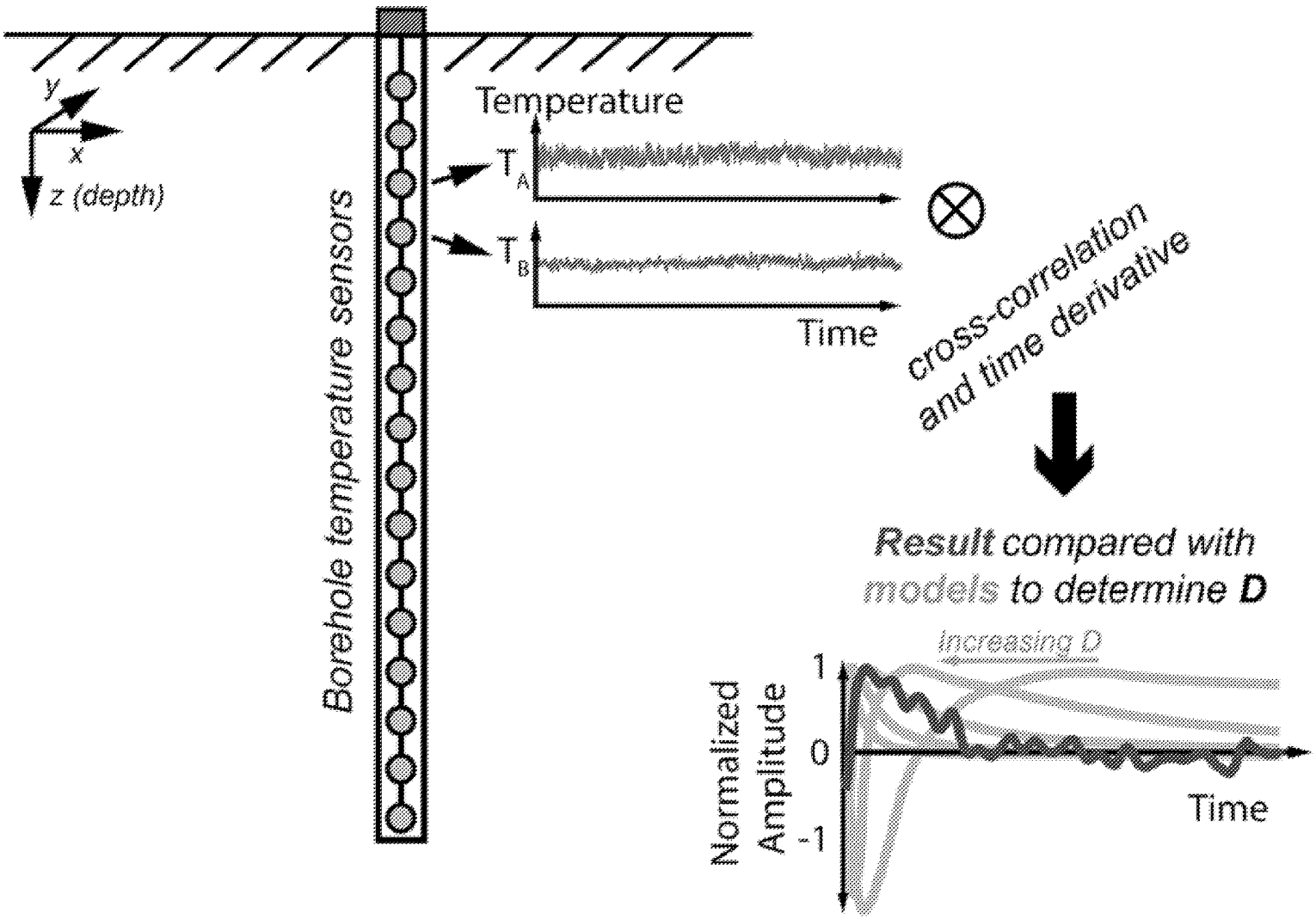
FIG. 2 illustrates aspects of an algorithm for determining subsurface hydraulic diffusivity from long-term temperature monitoring in an illustrative embodiment.

The temperature sensors 106 in some embodiments comprise respective borehole temperature sensors implemented at respective different depths within a borehole. An example of an arrangement of this type is shown in FIG. 2. Such temperature sensors can be implemented using Internet of Things (IoT) devices. Other types of wired or wireless temperature sensors can be used in other embodiments. As another example, the temperature sensors 106 can be associated with respective separate sensing positions along one or more fiber optic cables. Such an arrangement can be used to sense temperature at multiple positions along a given fiber optic cable. The term "temperature sensor" as used herein is intended to be broadly construed so as to encompass these and numerous other sensing arrangements.

The controlled system components 107 in some embodiments comprise equipment of a physical system implemented in an application associated with geothermal engineering, petroleum engineering or environmental engineering.

For example, controlled system components 107 can include valves or other fluid flow control mechanisms associated with at least one of a drilling operation, a subsurface monitoring operation, a resource extraction operation, an environmental remediation operation, and/or other types of components utilized in performing one or more operations in these or other applications. Such components can be at least partially controlled using estimates of subsurface hydraulic diffusivity or other reservoir properties determined in the manner disclosed herein. Numerous other types of physical systems, and their associated controlled components, can be used in other embodiments.

In some embodiments, the system 100 can be used to determine reservoir properties in wells long after they have been drilled and for monitoring activities separate from extraction or remediation. Again, numerous other applications are possible.

The processing platform 102 implements at least one long-term temperature monitoring module 110, at least one subsurface hydraulic diffusivity estimation algorithm 112 and at least one component controller 114. Examples of subsurface hydraulic diffusivity estimation algorithms for use in a variety of applications are described elsewhere herein. Subsurface hydraulic diffusivity is considered an example of what is more generally referred to herein as a "reservoir property," and other reservoir properties can be estimated in other embodiments. The term "reservoir property" as used herein is therefore intended to be broadly construed.

The long-term temperature monitoring module 110 obtains time-series temperature data directly from the temperature sensors 106, or indirectly from the temperature sensors 106 via one or more intermediary components not explicitly shown. For example, in some embodiments, the long-term temperature monitoring module 110 can communicate directly with the temperature sensors 106 over the network 104. It should be noted that references herein to "long-term" are intended to be broadly construed, and should not be viewed as limited to any particular range of temporal durations.

The subsurface hydraulic diffusivity estimation algorithm 112 is illustratively configured to generate estimates of subsurface hydraulic diffusion based on time-series temperature data obtained directly or indirectly from the temperature sensors 106 via the long-term temperature monitoring module 110.

For example, in some embodiments, for each of a plurality of pairs of the temperature sensors 106, the subsurface hydraulic diffusivity estimation algorithm 112 computes a cross-correlation of their corresponding time-series temperature data, computes a time derivative of the cross-correlation, and generates a subsurface hydraulic diffusivity estimate based at least in part on the time derivative of the cross-correlation.

More particularly, for a given one of the pairs of temperature sensors, an estimate of subsurface hydraulic diffusivity can be generated based at least in part on the time derivative of the cross-correlation and a distance between the given pair of temperature sensors.

In some embodiments, this involves generating the estimate based at least in part on a comparison of the time derivative of the cross-correlation to one or more temperature response models. For example, the estimate of subsurface hydraulic diffusivity is illustratively given by a particular subsurface diffusivity value that maximizes correlation between the time derivative of the cross-correlation and a particular temperature response model. Numerous alternative estimation arrangements may be used.

As another example, estimates of subsurface hydraulic diffusivity are generated for respective different pairs of the temperature sensors and utilized to generate an estimate of variation in the subsurface hydraulic diffusivity as a function of depth. A more particular illustration of such an arrangement will be described below in conjunction with the embodiment of FIG. 4.

The processing platform 102 is further configured to perform at least one automated action based at least in part on one or more estimates generated by the subsurface hydraulic diffusivity estimation algorithm 112.

In some embodiments, automated actions are performed using the component controller 114. For example, the component controller 114 can generate one or more control signals for setting, adjusting or otherwise controlling various operating parameters associated with the controlled system components 107 based at least in part on outputs generated by the subsurface hydraulic diffusivity estimation algorithm 112.

As a more particular example, the component controller 114 can generate one or more control signals that are used to set, adjust or otherwise control operating parameters of respective controlled components of physical system configured to perform a drilling operation, a resource extraction operation, an environmental remediation operation, or other type of operation. A wide variety of different mechanisms may be initiated or otherwise triggered by the component controller 114 based at least in part on estimates generated by the subsurface hydraulic diffusivity estimation algorithm 112. Terms such as "control" and "control signal" as used herein are therefore also intended to be broadly construed.

In other embodiments, the processing platform 102 need not be configured to perform any particular automated action using the one or more estimates generated by the subsurface hydraulic diffusivity estimation algorithm 112.

The operational information database 108 is illustratively configured to store outputs generated by the subsurface hydraulic diffusivity estimation algorithm 112 and/or the component controller 114, in addition to the above-noted operational information relating to operation of the controlled system components 107.

Although the subsurface hydraulic diffusivity estimation algorithm 112 and the component controller 114 are both shown as being implemented on processing platform 102 in the present embodiment, this is by way of illustrative example only. In other embodiments, the subsurface hydraulic diffusivity estimation algorithm 112 and the component controller 114 can each be implemented on a separate processing platform.

A given such processing platform is assumed to include at least one processing device comprising a processor coupled to a memory. Examples of such processing devices include computers, servers or other processing devices arranged to communicate over a network. Storage devices such as storage arrays or cloud-based storage systems used for implementation of operational information database 108 are also considered "processing devices" as that term is broadly used herein.

It is also possible that at least portions of other system elements such as the controlled system components 107 can be implemented as part of the processing platform 102, although shown as being separate from the processing platform 102 in the figure.

The processing platform 102 is configured for bidirectional communication with the user terminals 105 over the network 104. For example, images, displays and other outputs generated by the processing platform 102 can be transmitted over the network 104 to user terminals 105 such as, for example, a laptop computer, tablet computer or desktop personal computer, a mobile telephone, or another type of computer or communication device, as well as combinations of multiple such devices. The processing platform 102 can also receive input data from the temperature sensors 106, controlled system components 107 and/or other data sources, such as one or more other external data sources, over the network 104.

The network 104 can comprise, for example, a global computer network such as the Internet, a wide area network (WAN), a local area network (LAN), a satellite network, a telephone or cable network, a cellular network such as a 3G, 4G or 5G network, a wireless network implemented using a wireless protocol such as Bluetooth, WiFi or WiMAX, or various portions or combinations of these and other types of communication networks.

Examples of automated actions that may be taken in the processing platform 102 responsive to outputs generated by the subsurface hydraulic diffusivity estimation algorithm 112 include generating in the component controller 114 at least one control signal for controlling at least one of the controlled system components 107 over the network 104, generating at least a portion of at least one output display for presentation on at least one of the user terminals 105, generating an alert for delivery to at least one of the user terminals 105 over the network 104, and storing the outputs in the operational information database 108. Additional or alternative automated actions may be taken in other embodiments. The term "automated action" as used herein is therefore intended to be broadly construed.

Also, as indicated previously, other embodiments need not perform any particular automated actions using outputs generated by the subsurface hydraulic diffusivity estimation algorithm 112. Instead, for example, one or more user-directed and/or selectable actions may be performed in other embodiments without implementing automation of any particular one of the actions.

The processing platform 102 in the present embodiment further comprises a processor 120, a memory 122 and a network interface 124. The processor 120 is assumed to be operatively coupled to the memory 122 and to the network interface 124 as illustrated by the interconnections shown in the figure.

The processor 120 may comprise, for example, a microprocessor, an application-specific integrated circuit (ASIC), a field-programmable gate array (FPGA), a central processing unit (CPU), an arithmetic logic unit (ALU), a digital signal processor (DSP), or other similar processing device component, as well as other types and arrangements of processing circuitry, in any combination.

As a more particular example, in some embodiments, the processor 120 comprises one or more graphics processor integrated circuits. Such graphics processor integrated circuits are illustratively implemented in the form of one or more graphics processing units (GPUs). Accordingly, in some embodiments, system 100 is configured to include a GPU-based processing platform.

The memory 122 stores software program code for execution by the processor 120 in implementing portions of the functionality of the processing platform 102. For example, at least portions of the functionality of long-term temperature monitoring module 110, subsurface hydraulic diffusivity estimation algorithm 112 and component controller 114 can be implemented using program code stored in memory 122.

A given such memory that stores such program code for execution by a corresponding processor is an example of what is more generally referred to herein as a processor-readable storage medium having program code embodied therein, and may comprise, for example, electronic memory such as SRAM, DRAM or other types of random access memory (RAM), flash memory, read-only memory (ROM), magnetic memory, optical memory, or other types of storage devices in any combination.

Articles of manufacture comprising such processor-readable storage media are considered embodiments of the invention. The term "article of manufacture" as used herein should be understood to exclude transitory, propagating signals.

Other types of computer program products comprising processor-readable storage media can be implemented in other embodiments.

In addition, embodiments of the invention may be implemented in the form of integrated circuits comprising processing circuitry configured to implement processing operations associated with one or more of the long-term temperature monitoring module 110, subsurface hydraulic diffusivity estimation algorithm 112 and the component controller 114 as well as other related functionality.

The network interface 124 is configured to allow the processing platform 102 to communicate over one or more networks with other system elements, and may comprise one or more conventional transceivers.

In some embodiments, a physical system such as a system implemented in a geothermal engineering application, a petroleum engineering application or an environmental engineering application, is illustratively configured by generating one or more control signals in component controller 114 for application to the controlled system components 107 via network 104. Such control signals are generated based at least in part on outputs provided by the subsurface hydraulic diffusivity estimation algorithm 112. Other physical system configuration and control arrangements can be used in other embodiments.

It is to be appreciated that the particular arrangements of components and other system elements shown in FIG. 1 is presented by way of illustrative example only, and numerous alternative embodiments are possible. For example, other embodiments of information processing systems can be configured to provide reservoir property determination functionality of the type disclosed herein.

As indicated previously, characterization of hydrogeologic properties within the subsurface is important for understanding the factors controlling fluid flow and transport processes. Determining hydrogeologic properties within the subsurface is also important for understanding groundwater energy reservoirs and fault zones. However, in situ quantitative measurements commonly require active perturbation to the subsurface and often only result in a single broadly representative parameter estimate, such as a broadly representative estimate over an area. Illustrative embodiments overcome these and other drawbacks of conventional practice.

In some embodiments, techniques are provided for determining properties that control fluid flow through rocks from background noise in underground temperature data. Such techniques may be used in systems for determining subsurface hydraulic diffusivity at multiple depths through passive time-series recordings of temperature fluctuations in a borehole. An example of such a system will be described below in the context of a borehole through the fault that made the 2011 9.1 moment magnitude scale ($M_w$) Tohoku-oki earthquake. The cross-correlation of detrended temperature data from pairs of sensor depths is used to determine the hydraulic diffusivity. From experimental results on data obtained from the borehole through the fault that made the 2011 9.1 $M_w$ Tohoku-oki earthquake, we have determined that the resulting diffusivity estimates and depth variations are consistent with the previously inferred fault structure. Thus, the techniques described herein open up the possibility for passive determination of reservoir properties in a wide variety of settings.

Determining the properties that control fluid flow and pressure migration through rocks is essential for many tasks, including but not limited to understanding groundwater, energy reservoirs and fault zones. However, direct measurements of these properties underground generally require large disturbances like pumping out or injecting in lots of water, and result in only a single estimate. Here, we show that hydraulic diffusivity can be determined at multiple depths by analyzing small background variations in underground temperatures. We apply this technique to temperature data collected in a hole that was drilled through the fault that made the 2011 $M_w$ 9.1 Tohoku-oki, Japan earthquake and tsunami. Analysis of the background noise in these measurements reveals estimates of hydraulic diffusivity and depth variations that are consistent with expectations.

Hydraulic diffusivity is the key parameter that controls pressure migration in reservoirs. There is a need to determine it in situ for energy, groundwater, and earthquake applications. Most current methods rely on either active pumping between wells or proxies, such as seismic velocity or the migration time of microseismicity. Active pumping is expensive, invasive and sensitive to a limited set of scales while proxies are difficult to calibrate. A few studies passively use natural forcing from solid Earth tides, which can be sensitive to structure at a certain scale determined by the tidal periods and is only applicable in restricted situations where the tide couples strongly to the system.

Here we take a different approach. We combine the fact that fluid flow can cause borehole temperature perturbations, and the observation that in situ temperature fluctuates constantly, to devise a method to measure hydraulic diffusivity from the ambient noise in the temperature field. Temperature sensing may be used to measure fluid flow rates. The use of ambient noise in the temperature data provides a novel approach. We calculate hydraulic diffusivity from ambient temperature fluctuations by cross-correlating pairs of sensors and finding a median value of the correlation as a function of time lag. The time-derivative of this correlation is a unique function dependent on the distance between sensors and hydraulic diffusivity. This functional form is compared with predictions for the sensor spacing allowing the hydraulic diffusivity between two sensors to be determined. By performing computations for each sensor pair of a plurality of sensor pairs, we produce estimates of the hydraulic diffusivity as a function of depth and can evaluate the dependence on spatial scale. Below, we outline the framework for determining diffusivity estimates from ambient noise pressure variations, and then extend that to allow for determinations from the resulting pressure gradients or fluid flow rates, and then finally from signatures of advection in temperature measurements. We illustrate the power of the approach by using the temperature data collected by the Japan Trench Fast Drilling Project (JFAST)'s instrument deployment in a borehole penetrating the 2011 Tohoku-oki earthquake fault.

FIG. 2 illustrates a system for determining subsurface hydraulic diffusivity at multiple depths through passive time-series recordings of temperature fluctuations in boreholes. More particularly, this illustrative embodiment provides a system for determining hydraulic diffusivity, D, from long-term temperature monitoring. An example determination for one particular pair of observation depths is also shown in the figure.

The system in this illustrative embodiment comprises a string of fine-resolution temperature sensors installed underground within a borehole, either inside or outside of casing. In operation, the system measures temperature time-series at each sensor depth and records natural fluctuations due to small-scale transient fluid advection within the formation. This fluid advection is presumed to result from gradients in pore fluid pressure at various depths resulting from ambient seismic noise or other natural or anthropogenic sources of transient poroelastic disturbance over time. The system computes a cross-correlation of detrended temperature data from pairs of sensor depths over several windows of time and finds a median value of the correlation as a function of time lag. The time-derivative of this correlation is a unique function dependent on the distance between sensors and hydraulic diffusivity. This functional form is compared with predictions for the sensor spacing allowing the hydraulic diffusivity between the two sensors to be determined, as illustrated in FIG. 2.

By performing computations for each sensor pair, the system of FIG. 2 can produce estimates of the hydraulic diffusivity as a function of depth and can evaluate the dependence on spatial scale.

Previous studies have illustrated theoretically how the Green's function, i.e. the impulse response function, for pressure diffusion between two points can be reconstructed by taking the time derivative of the cross-correlation of pressure time-series data assuming the background fluctuations arise from spatially distributed random sources. This is expressed mathematically by Equation 1:

$$(G(r_B, r_A, t) - G(r_B, r_A, -t)) * C_s(t) = -2\frac{d}{dt}\langle p(r_A, t) \otimes p(r_B, t)\rangle, \tag{1}$$

where on the left-hand side, G is the Green's function between receivers (i.e. observation points) $r_B$, and $r_A$, as a function of time t, $C_s(t)$ is the autocorrelation of the source function, and * denotes convolution. On the right-hand side p is the pressure time series for each receiver and ⊗ denotes cross-correlation.

The empirically-derived impulse response function for diffusion is also defined analytically by Equation 2:

$$G(r_B, r_A, t) = \frac{M}{2^n(\pi Dt)^{n/2}}\exp\left(-\frac{L^2}{4Dt}\right), \tag{2}$$

where D is hydraulic diffusivity, n is the number of spatial dimensions for either 1D, 2D, or 3D diffusion, and M is the unit source strength in appropriate dimensional units. In short, Equations 1 and 2 state that the derivative of the cross-correlation of ambient noise within pressure time-series data provides a known functional form dependent solely on the distance between the observations and the hydraulic diffusivity.

In application, ambient noise diffusion analysis is similar to ambient noise seismology, which is a well-established means of determining seismic properties from interferometry of measurements of ambient seismic noise based on theoretical constructions of the wave equation. Ambient noise interferometry for diffusion, however, follows a separate foundational logic built upon the diffusion equation.

Figure 3:
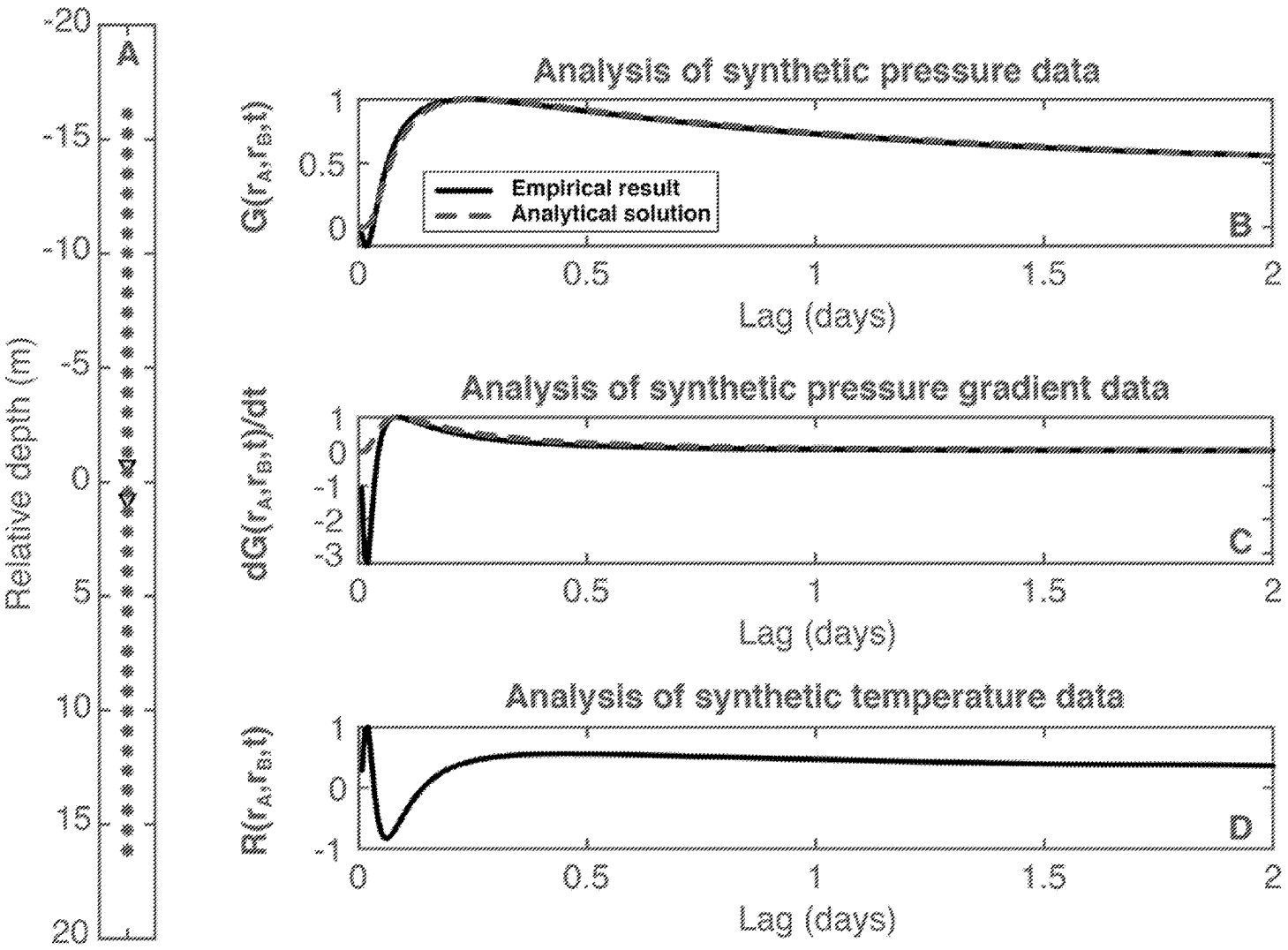
FIG. 3 shows examples of one-dimensional synthetic modeling in illustrative embodiments. This figure includes four distinct portions, referred to herein as FIGS. 3A, 3B, 3C and 3D, respectively.

In contrast to ambient noise seismology, sensitive instrumentation and short distances between observations are necessary due to the diffusive nature of the signals. In addition, a fundamental assumption is a requirement of volumetrically distributed random sources of perturbation. However, it has been illustrated that this assumption can be partially relaxed, and that the Green's function can be reconstructed from a finite number of discrete sources as long as they are volumetrically distributed around the observation points. For example, FIG. 3 shows simulation of 34 sources with a spatial density of 1.147 $m^{-1}$ around two observations points and random in time (FIG. 3A). Following Equation 1 above, the analysis of the pressure signals from these sources results in an empirical Green's function that closely resembles the analytical solution (Equation 2) and accurately estimates the hydraulic diffusivity (FIG. 3B).

FIG. 3 illustrates one-dimensional synthetic modeling in an illustrative embodiment, and as previously noted includes four distinct portions referred to herein as FIG. 3A, FIG. 3B, FIG. 3C and FIG. 3D. FIG. 3A shows the distribution of 34 discrete sources of pressure perturbation (shown as gray stars) with a source density of 1.147 $m^{-1}$ around two observation points (shown as triangles) 1.5 m apart and random in time. FIG. 3B shows the results of the ambient noise interferometry analysis on the resulting pressure time-series at the two observation points. FIG. 3C shows the results of analyzing the resulting pressure gradient time-series, and FIG. 3D shows the results from analyzing the resulting time-series of temperature fluctuations.

In practice, ambient pressure perturbations may come from natural or engineered perturbations within an active well field, or perhaps from the poroelastic response from the ambient seismic wave field. Background acoustic vibrations from surface noise and distant earthquakes cause rocks to transiently compress and/or dilate and can result in volumetrically heterogeneous small amplitude pressure perturbations. Temperature measurements inside a cased borehole must also guard against interpreting noise generated by borehole circulation. Designing a sufficiently narrow borehole or placing instrumentation outside the casing can be effective strategies.

Similar to the analysis of pressure diffusion above, it can be shown that measurements of the spatial gradient of pressure or fluid flow rate (pressure gradient times hydraulic conductivity, K) can be used to reconstruct the Green's function for fluid flow, which is also solely dependent on the spacing between observations and hydraulic diffusivity.

This is expressed mathematically by taking the spatial gradient of Equations 1 and 2, resulting in Equations 3 and 4:

$$K\left(\frac{dG(r_B, r_A, t)}{dt} - \frac{dG(r_B, r_A, -t)}{dt}\right) * C_s(t) = -2\frac{d}{dt}\left\langle\frac{dp(r_A, t)}{dz} \otimes \frac{dp(r_B, t)}{dz}\right\rangle, \tag{3}$$

and $$\frac{dG(r_B, r_A, t)}{dt} = \left(\frac{L}{2Dt}\right) \cdot G(r_B, r_A, t), \tag{4}$$

where $$\frac{dG}{dt}$$

is the time derivative of the Green's function for pressure diffusion, and $$\frac{dp}{dz}$$

is the pressure gradient at each observation point.

Whereas FIG. 3B analyzed synthetic pressure time-series data at two observation points resulting from discrete sources of pressure perturbation, FIG. 3C shows the results in which time-series of the resulting pressure gradients at the two observation points are used instead. The result, following Equation 3, is an empirical estimate that closely reconstructs the spatial gradient of the Green's function for diffusion, especially at mid- to later-times (FIG. 3C).

It is important to note that in comparing the empirical and analytical Green's functions or their derivatives, the amplitudes are normalized since the shape and timing of the curves are of greatest importance rather than the amplitude which depends on the average source strength over time.

Thus, the normalized results in FIG. 3C are the same whether observations of fluid flow rate or pressure gradient are used, since fluid flow rate is defined by Darcy's law as pressure gradient times hydraulic conductivity, which we treat as a representative constant.

Unlike for pressure diffusion and fluid flow, there is not a simple analytical solution for the time-dependent temperature response to vertical fluid flow in response to a transient pressure perturbation. The temperature response is quite different than a Green's function impulse response. Instead of the greatest signal being at the source, at initial times and short distances away from the source where pressure and fluid flow rates are greatest, the temperature response is small, as fluids have only flowed a short distance and any advected heat is similar to background temperatures. However, as heat is advected further distances from the initial vertical position it becomes more anomalous relative to background temperatures.

A steady-state solution to the vertical heat advection problem notes that the maximum amplitude of an advective temperature change from vertical fluid flow along a gradient is dependent on the temperature difference between the source location of the fluid and the observation point which is controlled by the background geotherm. It is also highly dependent on fluid flow rate, as heat diffusion becomes more dominant at lower velocities.

An approximation of the effects of time-dependent heat advection by transient vertical fluid flow follows:

$$T(r_B, r_A, t) \approx \left(\Delta z \frac{dT}{dz}\right) \cdot K \frac{dG(r_B, r_A, t)}{dt}, \tag{5}$$

in which the temperature response to an impulse pressure transient is defined by the fluid flow rate (Equation 4) multiplied by the difference in background temperature at a given vertical position relative to the source location $$\left(\text{i.e. } \Delta z \frac{dT}{dz}\right).$$

In the simplest form, $$\frac{dT}{dz}$$

is assumed constant. In the fully nonlinear form, $$\frac{dT}{dz}$$

evolves with the flow. Although highly simplified, the behavior of this approximation broadly describes the temperature response to transient pulses of vertical fluid flow observed and modeled with fully coupled finite element modeling approaches.

Similar to FIGS. 3B and 3C, FIG. 3D shows the result of simulations that model the temperature response to ambient pressure fluctuations. Like the analysis for pressure or fluid flow rate or pressure gradient above, the time-derivative of the cross-correlation between two temperature time-series results in a unique functional form, R, depending on the distance between observation points and the hydraulic diffusivity:

$$(R(r_B, r_A, t) - R(r_B, r_A, -t)) * C_s(t) = -2\frac{d}{dt}\langle T(r_A, t) \otimes T(r_B, t)\rangle. \tag{6}$$

Although this functional form, R, does not relate to an analytical solution like Equations 2 and 4, comparing results from forward models of the temperature response of two observation points with a given vertical spacing Δz to randomly distributed pressure perturbations allows for hydraulic diffusivity to be determined.

Figure 4:
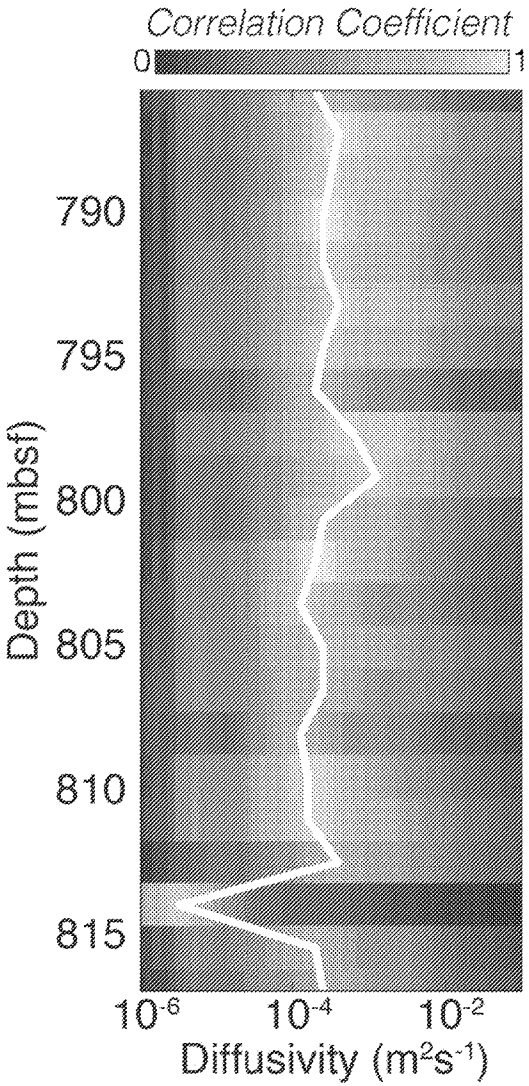
FIG. 4 illustrates an example output display comprising a heat map of optimal diffusivity estimates as a function of depth in an application involving sub-seafloor borehole temperature sensors.

FIG. 4 shows results of an application of the FIG. 2 system to a sub-seafloor borehole observatory that penetrated the plate-boundary fault beneath the Japan trench (e.g., the fault that made the 2011 9.1 $M_w$ Tohoku-oki earthquake) within highly faulted and fractured mudstones. The deployment was designed to capture the frictional heat of the fault, and the long-term, spatially-dense temperature measurements fortuitously also provide an opportunity to explore the ambient noise. More particularly, FIG. 4 illustrates preliminary results from the JFAST borehole offshore NE Japan with 1.5 m sensor spacing. The shadings represent the cross-correlation coefficient between observational result and models for various hydraulic diffusivity values at various depths in units of meters below seafloor (mbsf). The diffusivity D that maximizes the correlation between model and observational result between each sensor pair is plotted by a white line.

The vertical spacing of temperature sensors in this embodiment is 1.5 m inside a sealed unperforated borehole casing, and temperature fluctuations range from a few to several tens of milliK ($10^{-3}$-$10^{-1}$° C.). The FIG. 4 heat map identifies optimal estimates of diffusivity as a function of depth in mbsf determined following the procedures illustrated in FIG. 2. The shadings represent the correlation coefficient between ambient noise-derived advection response functions R for each pair of neighboring sensors (Equation 6) and synthetic models for various hydraulic diffusivity values. The diffusivity D that maximizes the correlation between model and observations for each sensor pair is plotted by a white line. The resulting estimates of D are similar for the different depths and generally around $3\times10^{-4}$ $m^2s^{-1}$. Assuming a formation compressibility of $7\times10^{-9}$ $Pa^{-1}$, these values correspond to permeabilities around $2\times10^{-15}$ $m^2$, which is consistent with typical values for this environment and scale of observation. Previous work inferred that the fault zone at ~820 meters below seafloor has lower permeability than the surrounding regions based on the longer recovery time of the thermal drilling disturbance and clay-rich core samples. The ambient noise approach measures a lower hydraulic diffusivity just above this zone and then reduced correlation within the zone. The low correlation for the bottom-most sensors may be expected because of the extremely low permeability reducing ambient flow.

Monitoring of formation pressure or fluid flow rate at different depths, let alone multiple closely-spaced depths within a borehole, can be difficult and cost-prohibitive. However, borehole temperature monitoring can effectively provide insight into fluid flow rates across many depths. Since background temperature typically increases with depth along a geothermal gradient, vertical fluid flow tends to advect heat that can be observable with sensitive temperature sensing equipment. This system utilizes temperature fluctuations associated with vertical fluid flow in response to ambient pressure perturbations to determine hydraulic diffusivity. A potential complication could be borehole circulation which could create vertical flow within the cased borehole unrelated to the formation properties. This borehole was designed to minimize borehole circulation although eliminating it entirely is never ensured. However, it is unlikely that such a flow would produce response function variations that correspond to the known structure of the fault.

The ability of ambient noise thermometry to passively determine hydraulic diffusivity at multiple depths is beneficial to a wide range of industries and problems involving subsurface flow, including environmental remediation, groundwater management, resource engineering, and earthquake physics. Hydraulic diffusivity is the key parameter controlling fluid pressure, and zones of natural or artificially enhanced high diffusivity are often exploited for fluid or heat extraction or sometimes avoided to ensure drilling and environmental safety. The use of ambient noise in temperature data avoids perturbing the studied environment and can produce high-resolution diffusivity information in situ. This approach can identify and characterize zones of high hydraulic diffusivity which may otherwise be overlooked or underestimated in traditional well tests and assessments.

The ability of this system to passively determine hydraulic diffusivity at multiple depths is beneficial to a wide range of subsurface industries.

For example, in geothermal applications, laterally-connected flow paths with high permeability or hydraulic diffusivity are required to circulate fluids through the subsurface and extract heat. This system can help identify these permeable zones and provide quantitative estimates of the properties controlling the ease of fluid movement. Adjustments to various system operating parameters can be made responsive to the quantitative estimates.

Similarly, in oil and gas and water resource applications, permeable units with high hydraulic diffusivity provide pathways from which hydrocarbons or fresh water can be effectively extracted.

In many geothermal and oil and gas reservoirs, hydraulic fracturing is used to enhance the permeability and hydraulic diffusivity within targeted regions within the subsurface. This system can precisely identify the location of the resulting enhanced permeable zones and provide quantitative estimates of the new hydrologic properties to assess how effective the permeability enhancement process was. Again, adjustments to various system operating parameters can be made responsive to the quantitative estimates.

Knowledge of the depth distribution of hydrologic properties is also important for well design and drilling safety. This system can help identify and characterize formations and structures behind casing that may be susceptible to rapid infiltration of drilling fluids in subsequent wells drilled within the region. The process of rapid infiltration of drilling fluids into formations or structures with very high hydraulic diffusivity can cause loss of circulation and result in a blowout or environmental contamination. Such situations can be avoided through automated actions performed based on estimates of subsurface hydraulic diffusivity or other reservoir properties as disclosed herein.

In environmental applications, permeable zones with high hydraulic diffusivity control groundwater flow and chemical transport. This system determines the hydrologic properties controlling fluid flow and transport and can identify and characterize thin zones of high hydraulic diffusivity which may be important flow paths but could otherwise be overlooked or underestimated in traditional well tests and assessments.

In these and other embodiments, estimates generated by a subsurface hydraulic diffusivity estimation algorithm as disclosed herein can be used to make adjustments to various operating parameters of controlled components, possibly in an automated manner driven by a processing platform such as that described in conjunction with FIG. 1.

The particular processing operations and other system functionality described in conjunction with the diagrams of FIGS. 2, 3 and 4 herein are presented by way of illustrative example only, and should not be construed as limiting the scope of the disclosure in any way. Alternative embodiments can use other types of processing operations for implementing reservoir property determination functionality.

For example, the ordering of the process steps may be varied in other embodiments, or certain steps may be performed at least in part concurrently with one another rather than serially. Also, one or more of the process steps may be repeated periodically, or multiple instances of the process can be performed in parallel with one another in order to implement a plurality of different instances of a subsurface hydraulic diffusivity estimation algorithm each configured to process data from long-term temperature monitoring of borehole temperature sensors or other types of temperature sensors.

Functionality such as that described in conjunction with the diagrams of FIGS. 2, 3 and 4 can be implemented at least in part in the form of one or more software programs stored in memory 122 and executed by processor 120 within the processing platform 102. A memory or other storage device having executable program code of one or more software programs embodied therein is an example of what is more generally referred to herein as a "processor-readable storage medium." Articles of manufacture or other computer program products each comprising one or more such processor-readable storage media are considered illustrative embodiments of the present disclosure.

As indicated above, the subsurface hydraulic diffusivity estimation algorithms disclosed herein are suitable for use in a wide variety of different applications. The particular application examples described above are for purposes of illustration only, and should not be construed as limiting in any way.

Like other aspects of the illustrative embodiments disclosed herein, the particular features and functionality of reservoir property determination and other techniques disclosed herein are presented by way of illustrative example only, and a wide variety of alternative features and functionality can be used in other embodiments. As indicated previously, terms such as "reservoir property" are intended to be broadly construed.

Accordingly, the embodiments described herein are considered illustrative only, and should not be viewed as limited to any particular arrangement of features. For example, those skilled in the art will recognize that alternative processing operations and associated system entity configurations can be used in other embodiments. It is therefore possible that other embodiments may include additional or alternative system elements, relative to the elements of the illustrative embodiments. Also, the particular processing modules, subsurface hydraulic diffusivity estimation algorithms, component controllers and other aspects of the illustrative embodiments can be varied in other embodiments.

It should also be noted that the above-described information processing system arrangements are exemplary only, and alternative system arrangements can be used in other embodiments.

A given client, server, processor or other component in an information processing system as described herein is illustratively configured utilizing a corresponding processing device comprising a processor coupled to a memory. The processor executes software program code stored in the memory in order to control the performance of processing operations and other functionality. The processing device also comprises a network interface that supports communication over one or more networks.

The processor may comprise, for example, a microprocessor, an ASIC, an FPGA, a CPU, an ALU, a DSP, a GPU or other similar processing device component, as well as other types and arrangements of processing circuitry, in any combination. For example, a given precomputation and parameter determination module of a processing device as disclosed herein can be implemented using such circuitry.

The memory stores software program code for execution by the processor in implementing portions of the functionality of the processing device. A given such memory that stores such program code for execution by a corresponding processor is an example of what is more generally referred to herein as a processor-readable storage medium having program code embodied therein, and may comprise, for example, electronic memory such as SRAM, DRAM or other types of RAM, flash memory, ROM, magnetic memory, optical memory, or other types of storage devices in any combination.

Articles of manufacture comprising such processor-readable storage media are considered embodiments of the invention. The term "article of manufacture" as used herein should be understood to exclude transitory, propagating signals.

Other types of computer program products comprising processor-readable storage media can be implemented in other embodiments.

In addition, embodiments of the invention may be implemented in the form of integrated circuits comprising processing circuitry configured to implement processing operations associated with reservoir property determination and associated automated component control as well as other related functionality.

Processing devices in a given embodiment can include, for example, computers, servers and/or other types of devices each comprising at least one processor coupled to a memory, in any combination. For example, one or more computers, servers, storage devices or other processing devices can be configured to implement at least portions of a processing platform comprising a subsurface hydraulic diffusivity estimation algorithm and/or a component controller as disclosed herein. Communications between the various elements of an information processing system comprising processing devices associated with respective system entities may take place over one or more networks.

An information processing system as disclosed herein may be implemented using one or more processing platforms, or portions thereof.

For example, one illustrative embodiment of a processing platform that may be used to implement at least a portion of an information processing system comprises cloud infrastructure including virtual machines implemented using a hypervisor that runs on physical infrastructure. Such virtual machines may comprise respective processing devices that communicate with one another over one or more networks.

The cloud infrastructure in such an embodiment may further comprise one or more sets of applications running on respective ones of the virtual machines under the control of the hypervisor. It is also possible to use multiple hypervisors each providing a set of virtual machines using at least one underlying physical machine. Different sets of virtual machines provided by one or more hypervisors may be utilized in configuring multiple instances of various components of the information processing system.

Another illustrative embodiment of a processing platform that may be used to implement at least a portion of an information processing system as disclosed herein comprises a plurality of processing devices which communicate with one another over at least one network. Each processing device of the processing platform is assumed to comprise a processor coupled to a memory.

Again, these particular processing platforms are presented by way of example only, and an information processing system may include additional or alternative processing platforms, as well as numerous distinct processing platforms in any combination, with each such platform comprising one or more computers, servers, storage devices or other processing devices.

For example, other processing platforms used to implement embodiments of the invention can comprise different types of virtualization infrastructure in place of or in addition to virtualization infrastructure comprising virtual machines. Thus, it is possible in some embodiments that system components can run at least in part in cloud infrastructure or other types of virtualization infrastructure, including virtualization infrastructure utilizing Docker containers or other types of Linux containers implemented using operating system level virtualization based on Linux control groups or other similar mechanisms.

It should therefore be understood that in other embodiments different arrangements of additional or alternative elements may be used. At least a subset of these elements may be collectively implemented on a common processing platform, or each such element may be implemented on a separate processing platform.

Also, numerous other arrangements of computers, servers, storage devices or other components are possible in an information processing system. Such components can communicate with other elements of the information processing system over any type of network or other communication media.

As indicated previously, components of the system as disclosed herein can be implemented at least in part in the form of one or more software programs stored in memory and executed by a processor of a processing device. For example, certain functionality associated with reservoir property determination and component control in a processing platform can be implemented at least in part in the form of software.

The particular configurations of information processing systems described herein are exemplary only, and a given such system in other embodiments may include other elements in addition to or in place of those specifically shown, including one or more elements of a type commonly found in a conventional implementation of such a system.

For example, in some embodiments, an information processing system may be configured to utilize the disclosed techniques to provide additional or alternative functionality in other contexts.

It is also to be appreciated that the particular process steps used in the embodiments described above are exemplary only, and other embodiments can utilize different types and arrangements of processing operations. For example, certain process steps shown as being performed serially in the illustrative embodiments can in other embodiments be performed at least in part in parallel with one another.

It should again be emphasized that the embodiments of the invention as described herein are intended to be illustrative only. Other embodiments of the invention can be implemented utilizing a wide variety of different types and arrangements of information processing systems, processing platforms, processing modules, processing devices, processing operations, reservoir properties, estimation algorithms, physical systems, operating parameters and component controllers than those utilized in the particular illustrative embodiments described herein. In addition, the particular assumptions made herein in the context of describing certain embodiments need not apply in other embodiments. These and numerous other alternative embodiments will be readily apparent to those skilled in the art.

What is claimed is:

1. An apparatus comprising:

at least one processing device comprising a processor coupled to a memory;

said at least one processing device being configured:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein generating an estimate of at least one reservoir property based at least in part on the time derivative of the cross-correlation comprises, for a given one of the pairs of temperature sensors, generating an estimate of subsurface hydraulic diffusivity based at least in part on the time derivative of the cross-correlation and a distance between the given pair of temperature sensors.

2. The apparatus of claim 1 wherein the temperature sensors comprise respective borehole temperature sensors arranged at respective different subsurface depths within a borehole.

3. The apparatus of claim 1 wherein generating the estimate of subsurface hydraulic diffusivity comprises generating the estimate based at least in part on a comparison of the time derivative of the cross-correlation to one or more temperature response models.

4. The apparatus of claim 3 wherein the estimate of subsurface hydraulic diffusivity is given by a particular subsurface diffusivity value that maximizes correlation between the time derivative of the cross-correlation and a particular temperature response model.

5. The apparatus of claim 1 wherein performing at least one automated action comprises generating at least a portion of at least one output display for presentation on at least one user terminal.

6. The apparatus of claim 1 wherein performing at least one automated action comprises generating an alert for delivery to at least one user terminal over a network.

7. An apparatus comprising:

at least one processing device comprising a processor coupled to a memory;

said at least one processing device being configured:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein reservoir property estimates comprising respective estimates of subsurface hydraulic diffusivity generated for respective different pairs of the temperature sensors are utilized to generate an estimate of variation in the subsurface hydraulic diffusivity as a function of depth.

8. The apparatus of claim 7 wherein the temperature sensors comprise respective borehole temperature sensors arranged at respective different subsurface depths within a borehole.

9. The apparatus of claim 7 wherein performing at least one automated action comprises generating at least a portion of at least one output display for presentation on at least one user terminal.

10. The apparatus of claim 7 wherein performing at least one automated action comprises generating an alert for delivery to at least one user terminal over a network.

11. An apparatus comprising:

at least one processing device comprising a processor coupled to a memory;

said at least one processing device being configured:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein the time derivative of the cross-correlation of the time-series temperature data for a given pair of the temperature sensors exhibits a relation to a temperature response function R that is characterized as follows:

$$(R(r_B, r_A, t) - R(r_B, r_A, -t)) * C_s(t) = -2\frac{d}{dt}\langle T(r_A, t) \otimes T(r_B, t)\rangle$$

where $r_A$ and $r_B$ denote observation points corresponding to the respective temperature sensors of the pair of temperature sensors, t denotes time, * denotes convolution, $C_s(t)$ denotes autocorrelation of a source function, $\otimes$ denotes cross-correlation, and T ($r_A$, t) and T ($r_B$, t) denote the time-series temperature data for the respective temperature sensors.

12. The apparatus of claim 11 wherein one or more models of the temperature response function R are utilized to generate an estimate of subsurface hydraulic diffusivity from the time derivative of the cross-correlation of the time-series temperature data for the given pair of temperature sensors.

13. The apparatus of claim 12 wherein the estimate of subsurface hydraulic diffusivity for the given pair of temperature sensors is given by a particular subsurface diffusivity value that maximizes correlation between the time derivative of the cross-correlation and a particular model of the temperature response function R.

14. The apparatus of claim 11 wherein the temperature sensors comprise respective borehole temperature sensors arranged at respective different subsurface depths within a borehole.

15. The apparatus of claim 11 wherein performing at least one automated action comprises generating at least a portion of at least one output display for presentation on at least one user terminal.

16. The apparatus of claim 11 wherein performing at least one automated action comprises generating an alert for delivery to at least one user terminal over a network.

17. An apparatus comprising:

at least one processing device comprising a processor coupled to a memory;

said at least one processing device being configured:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein performing at least one automated action comprises generating a control signal for controlling at least one component of a physical system.

18. The apparatus of claim 17 wherein the controlled component comprises a fluid flow control mechanism associated with at least one of a drilling operation, a subsurface monitoring operation, a resource extraction operation and an environmental remediation operation of the physical system.

19. The apparatus of claim 17 wherein the temperature sensors comprise respective borehole temperature sensors arranged at respective different subsurface depths within a borehole.

20. An apparatus comprising:

at least one processing device comprising a processor coupled to a memory;

said at least one processing device being configured:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein performing at least one automated action comprises controlling an amount of fluid flow into or out of a particular subsurface region.

21. The apparatus of claim 20 wherein the temperature sensors comprise respective borehole temperature sensors arranged at respective different subsurface depths within a borehole.

22. A method comprising:

obtaining time-series temperature data from respective temperature sensors arranged at respective different subsurface depths;

for each of a plurality of pairs of the temperature sensors:

computing a cross-correlation of their corresponding time-series temperature data;

computing a time derivative of the cross-correlation; and generating an estimate of at least one reservoir property based at least in part on the time derivative of the cross-correlation;

wherein at least one automated action is performed based at least in part on the generated estimate;

wherein generating an estimate of at least one reservoir property based at least in part on the time derivative of the cross-correlation comprises, for a given one of the pairs of temperature sensors, generating an estimate of subsurface hydraulic diffusivity based at least in part on the time derivative of the cross-correlation and a distance between the given pair of temperature sensors; and wherein the method is performed by at least one processing device comprising a processor coupled to a memory.

23. The method of claim 22 wherein generating the estimate of subsurface hydraulic diffusivity comprises generating the estimate based at least in part on a comparison of the time derivative of the cross-correlation to one or more temperature response models.

24. The method of claim 22 wherein the temperature sensors comprise respective borehole temperature sensors arranged at respective different subsurface depths within a borehole.

25. The method of claim 22 wherein performing at least one automated action comprises generating at least a portion of at least one output display for presentation on at least one user terminal.

26. The method of claim 22 wherein performing at least one automated action comprises generating an alert for delivery to at least one user terminal over a network.

27. A computer program product comprising a non-transitory processor-readable storage medium having stored therein program code of one or more software programs, wherein the program code when executed by at least one processing device causes said at least one processing device:

to obtain time-series temperature data from respective temperature sensors arranged at respective different subsurface depths;

for each of a plurality of pairs of the temperature sensors:

to compute a cross-correlation of their corresponding time-series temperature data;

to compute a time derivative of the cross-correlation; and to generate an estimate of at least one reservoir property based at least in part on the time derivative of the cross-correlation;

wherein at least one automated action is performed based at least in part on the generated estimate; and wherein generating an estimate of at least one reservoir property based at least in part on the time derivative of the cross-correlation comprises, for a given one of the pairs of temperature sensors, generating an estimate of subsurface hydraulic diffusivity based at least in part on the time derivative of the cross-correlation and a distance between the given pair of temperature sensors.

28. The computer program product of claim 27 wherein generating the estimate of subsurface hydraulic diffusivity comprises generating the estimate based at least in part on a comparison of the time derivative of the cross-correlation to one or more temperature response models.

29. The computer program product of claim 27 wherein the temperature sensors comprise respective borehole temperature sensors arranged at respective different subsurface depths within a borehole.

30. The computer program product of claim 27 wherein performing at least one automated action comprises generating at least a portion of at least one output display for presentation on at least one user terminal.

31. The computer program product of claim 27 wherein performing at least one automated action comprises generating an alert for delivery to at least one user terminal over a network.

* * * * *